US005111847A

United States Patent [19]

Hu et al.

[11] Patent Number: 5,111,847

[45] Date of Patent: May 12, 1992

[54] PNEUMATIC ACTUATOR

[75] Inventors: Fang-Quan Hu, Manchester; Michael Page, Staffordshire; John M. Watson, Manchester, all of England

[73] Assignee: Norgren Martonair Limited, United Kingdom

[21] Appl. No.: 683,540

[22] Filed: Apr. 10, 1991

[30] Foreign Application Priority Data

Apr. 10, 1990 [GB] United Kingdom ..... 9008153

[51] Int. Cl.[5] ..... F15C 1/04

[52] U.S. Cl. ..... 137/828; 137/842

[58] Field of Search ..... 137/828, 842

[56] References Cited

U.S. PATENT DOCUMENTS

| | | | |
|---|---|---|---|
| 3,428,068 | 2/1969 | Howie, Jr. | 137/842 |
| 3,534,754 | 10/1970 | Beeken | 137/828 |
| 3,566,896 | 3/1971 | Proniewicz | 137/842 |
| 3,591,809 | 7/1971 | Lankaniemi | 137/842 |
| 4,512,371 | 4/1985 | Drzewiecki et al. | 137/828 |
| 4,590,970 | 5/1986 | Mott | 137/828 |
| 4,689,827 | 8/1987 | Gurney, Jr. | 137/828 |

FOREIGN PATENT DOCUMENTS

| | | |
|---|---|---|
| 0285336 | 10/1988 | European Pat. Off. . |
| 1309082 | 5/1970 | United Kingdom . |
| 2165062 | 4/1986 | United Kingdom . |

OTHER PUBLICATIONS

Nomoto/Shimada-Ultrasonically Modulated Fluid-State Transducer-Faculty os Science and Engineering Sep. 1968.

*Primary Examiner*—A. Michael Chambers

*Attorney, Agent, or Firm*—Cushman, Darby & Cushman

[57] ABSTRACT

A pneumatic actuator comprises a cell through which a normally laminar flow of air passes between an inlet and an outlet to provide, in the outlet, an output pressure. The cell includes an electro-acoustic transducer, for example a piezo-electric element arranged, in response to an oscillating electrical signal, to produce an acoustic signal that disturbs the laminar flow whereby at least some of the air exhausts from the cell via one or more exhaust ports and the output pressure falls. The difference in the output pressures may be used to control a pneumatic device optionally via a pneumatic amplifier. The electrical signal is produced by an opto-electrical transducer to which optical control signals are transmitted, for example along a fibre optic cable.

9 Claims, 1 Drawing Sheet

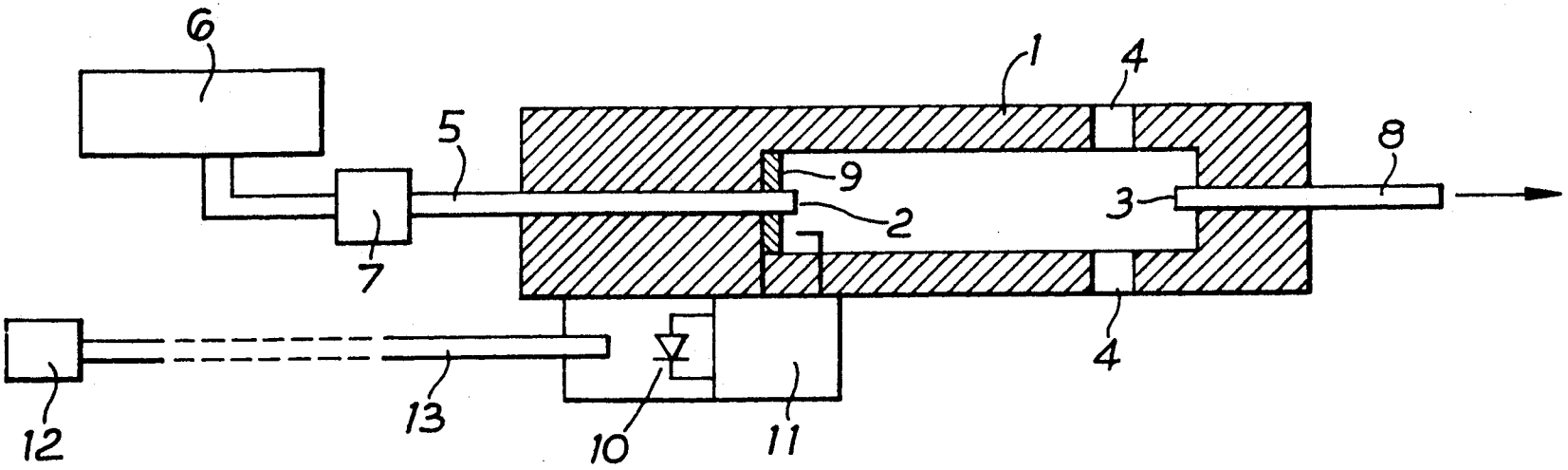
8
3
4
4
1
2
9
11
10
5
13
7
6
12

PNEUMATIC ACTUATOR

BACKGROUND OF THE INVENTION

This invention relates to pneumatic actuators.

Pneumatically-actuated devices are, of course, very widely used in all sorts of fields, especially in the control field.

Hitherto, it has been conventional practice to control such devices, such as fluid flow regulators, electrically using, for example, so-called I/P converters which produce varying pneumatic outputs in response to varying electrical input signals. By using such converters, remote and/or automatic control is possible. However, they do have disadvantages, especially as regards their response times, their susceptibility to electrical "noise" and, because of the need for relatively high power electrical control signals, their unsuitability for use in hazardous environments.

SUMMARY OF THE INVENTION

In accordance with the present invention, there is provided a pneumatic actuator in which the above disadvantages are overcome or at least mitigated. More particularly, the present invention provides, in its broadest aspect, a pneumatic actuator comprising:

(a) a cell having an inlet for pressurized gas, for example air, an outlet for said gas disposed opposite said inlet, and one or more exhaust outlets;

(b) means to control the flow of gas to said inlet so that, normally, a laminar stream of gas will flow through the cell from said inlet to said outlet thereby producing a pressure output at the outlet;

(c) an electro-acoustic transducer, preferably located within the cell, for producing, in response to an oscillating electrical signal, an acoustic signal for imparting turbulence to said laminar stream thereby causing at least some of the air in said stream to exhaust through said exhaust outlet(s) and thus a reduction in the value of said pressure output; and (d) an opto-electrical transducer responsive to optical control signals to provide, directly or indirectly, said electrical signal.

The laminar stream of gas may be disturbed, and therefore rendered turbulent, by an acoustic signal having an appropriate frequency and minimum amplitude that is generated by feeding an appropriate oscillating electrical signal to the electro-acoustic transducer which may, for example, be a piezo-electric element, for example in the form of an annular disc surrounding said gas inlet.

An actuator of the invention is, as will be noted, controlled by a primary optical control signal which is transduced by the opto-electrical transducer into an electrical signal, preferably via a matcher circuit. The opto-electrical transducer is preferably a photo-diode coupled to the electro-acoustic transducer by a matcher circuit, for example a transformer/inductance circuit. The optical source is therefore modulated at the aforementioned acoustic frequency and is preferably a coherent source, such as a laser. The light may be fed to the opto-electrical transducer by an optical fibre link, whereby the device may readily be controlled remotely. Optical fibre links have the advantage, relative to electrical cable links, of lower weight and volume and large signal band width.

An actuator of the invention operates as follows. Normally, as indicated above, the air (or other gas) flows through the cell from the inlet to the outlet in a laminar stream and most of the air emerges from the outlet to provide an output pressure; in other words, a relatively small amount, if any, is lost through the exhaust outlet(s) of the cell. However, when the stream is disturbed in the manner described, most of the air will vent through the exhaust outlet(s) and so there is a considerable drop in the output pressure. The ensuing change in the output pressure may be utilised to control the operation of, for example, a pneumatic device such as a pressure regulator. Because an actuator of the invention may use very rapid response transducers (such as a photodiode and a piezo-electric device), its overall response time is very fast and it is of high sensitivity and stability.

One embodiment of an actuator of the invention will now be described by way of example only with reference to the accompanying drawing.

DESCRIPTION OF THE PREFERRED EMBODIMENT

Referring to the drawing, the actuator comprises an elongate, cylindrical cell 1 having at one end a compressed air inlet jet 2 having a diameter of 0.5 mm and, at the other end, an opposed air outlet jet 3 having a diameter of 0.5 mm. The distance between the jet orifices is about 15 mm. The cell 1 has a number of exhaust ports 4 formed in its wall adjacent to the outlet jet 3.

The inlet jet 2 is defined by an end of a supply tube 5 which is connected to a source 6 of compressed air via a flow control valve 7. The outlet jet 3 is defined by an end of a tube 8.

The inlet jet 2 is surrounded by an annular piezo-electric disc 9 which is electrically connected to a photodiode 10 via a matcher 11 that comprises principally a transformer and an inductor. A modulated light source 12, typically having a power of the order of an optical fibre link 13.

During use, the flow control valve 7 is adjusted so that a stream of compressed air will normally flow, in laminar fashion, through the cell from the inlet jet 2 to the outlet jet 3, thereby producing an output pressure in the tube 8. The laminar stream may, however, be disturbed so as to render it turbulent by feeding an appropriately modulated light signal from the source 12 along the optical fibre link 13 and onto the photodiode 10 whereby an acoustic signal is generated by the piezo-electric disc 9.

The frequency and amplitude of the acoustic signal are selected in order to create such a disturbance. In the embodiment described, at an input pressure in the tube 5 of 0.43 psi, the effective signal frequency is of the order of 17 KHz but this may vary with the geometry etc of the arrangement. The requisite frequency and amplitude will depend on the precise arrangement but for any given case they may be determined by simple experiment.

Upon disturbance of the laminar stream, most if not all of the compressed air will exhaust through the ports 4, rather than through the outlet jet 3, and so the output pressure in the tube 8 will drop significantly. The tube 8 may be connected, usually via a pneumatic amplifier to, for example, the actuating section of a pressure regulator or on/off valve (not shown), the actuating section being responsive to the change in the output pressure in the tube 8.

A pneumatic actuator constructed in accordance with the invention has the particularly desirable advantage of very small response times relative to those of, for example, known I/P converters, an advantage which those skilled in the art have long been attempting to secure, hitherto, however, without success. More particularly, an actuator of the invention will typically have a response time of 5 milliseconds or less.

We claim:

1. A pneumatic actuator comprising:

(a) a cell having an inlet for pressurized gas, for example air, an outlet for said gas disposed opposite said inlet, and one or more exhaust outlets;

(b) means to control the flow of gas to said inlet so that, normally, a laminar stream of gas will flow through the cell from said inlet to said outlet thereby producing a pressure output at the outlet; and (c) an electro-acoustic transducer for producing, in response to an oscillating electrical signal, an acoustic signal for imparting turbulence to said laminar stream thereby causing at least some of the air in said stream to exhaust through said exhaust outlet(s) and thus a reduction in the value of said pressure output; and (d) an opto-electrical transducer responsive to optical control signals to provide, directly or indirectly, said electrical signal.

2. A pneumatic actuator according to claim 1 wherein said cell is substantially circular cylindrical with said inlet and outlet being disposed, respectively, at or adjacent to its ends.

3. A pneumatic actuator according to claim 1 wherein said electro-acoustic transducer is a piezo-electric device.

4. A pneumatic actuator according to claim 3 wherein said piezo-electric device is in the form of an annular disc surrounding, and located adjacent to, an end of a tube defining said inlet.

5. A pneumatic actuator according to claim 1 wherein the opto-electrical transducer is interfaced with the electro-acoustic transducer via a matching circuit.

6. A pneumatic actuator according to claim 1 wherein said opto-electrical transducer is a photodiode.

7. A pneumatic actuator according to claim 1 wherein said opto-electrical transducer is responsive to suitable laser or infra-red control signals.

8. A pneumatic actuator according to claim 1 wherein said opto-electrical transducer is adapted to receive suitably modulated optical control signals transmitted to it along a fibre optic link.

9. A pneumatic system including a pneumatically-operated device, for example a fluid flow control valve, and an actuator as claimed in claim 1 for actuating said device optionally via a pneumatic amplifier.

* * * * *